US007146246B2

(12) United States Patent
Clarke

(10) Patent No.: US 7,146,246 B2
(45) Date of Patent: Dec. 5, 2006

(54) DISPENSING DEVICE

(76) Inventor: Stephen William Clarke, 7 Longridge Road, Hurst Green, Clitheroe, Lancashire BB7 9QW (GB)

( * ) Notice: Subject to any disclaimer, the term of this patent is extended or adjusted under 35 U.S.C. 154(b) by 140 days.

(21) Appl. No.: 10/471,801

(22) PCT Filed: Mar. 15, 2002

(86) PCT No.: PCT/GB02/01272

§ 371 (c)(1),
(2), (4) Date: Mar. 24, 2004

(87) PCT Pub. No.: WO02/074138

PCT Pub. Date: Sep. 26, 2002

(65) Prior Publication Data

US 2004/0144794 A1 Jul. 29, 2004

(30) Foreign Application Priority Data

Mar. 16, 2001 (GB) ..... 0106500.2

(51) Int. Cl.
*G06F 17/00* (2006.01)
*G07F 11/00* (2006.01)

(52) U.S. Cl. ..... 700/236; 700/241; 221/6; 221/130; 221/131

(58) Field of Classification Search ..... 221/9, 221/10, 174, 281, 155, 6, 2, 156, 160, 200, 221/17, 154; 312/35, 42, 117; 700/241, 700/236

See application file for complete search history.

(56) References Cited

U.S. PATENT DOCUMENTS 4,597,506 A 7/1986 Eglise et al.
4,706,794 A * 11/1987 Awane et al. ..... 221/6
4,845,486 A 7/1989 Knight et al.
4,940,162 A 7/1990 Thie
5,133,480 A 7/1992 Matsumoto et al.
5,207,784 A * 5/1993 Schwartzendruber ..... 221/6
5,405,045 A * 4/1995 Usmani ..... 221/7
5,598,947 A * 2/1997 Smith ..... 221/150 HC
6,050,447 A * 4/2000 Kovens et al. ..... 221/125

FOREIGN PATENT DOCUMENTS

GB 2 327 668 2/1999
GB 2327668 A * 3/1999

* cited by examiner

*Primary Examiner*—Gene O. Crawford
*Assistant Examiner*—Timothy Waggoner
(74) *Attorney, Agent, or Firm*—Smith, Gambrell & Russell, LLP

(57) ABSTRACT

A dispenser has an upper loading chamber (38), a dispensing chamber (40) located beneath the loading chamber, first and second openable covers (24, 34) for the loading chamber (38) and a dispensing chamber (40) and a gate means (32) mounted in the housing between the two chambers and forming a lower wall of the loading chamber (38). The gate means (32) is movable to allow selective communication of a loading chamber (38) and the dispensing chamber (40) to allow the contents of the loading chamber to fall into the dispensing chamber (40). Opening of the gate means (32) to an extent sufficient to allow the contents to fall into the dispensing chamber generates a signal from a limit switch (59) indicative that the loading chamber (38) is empty.

39 Claims, 5 Drawing Sheets

DISPENSING DEVICE

The present invention relates to dispensing devices and systems comprising dispensing devices.

In engineering workshops and on production lines and the like, it is often the case that many components are needed very frequently during manufacture or assembly. For example in a production line for a major part (e.g. a wing) of an aircraft, it may be necessary for many different types and sizes of rivets to be repeatedly used in the construction of the part.

To facilitate manufacture or assembly it is common practice for frequently-used components to be stored in a series of open trays or bins. When a particular component is required it is necessary merely to reach into one of the trays or bins and select the appropriate component.

One of the problems with such an arrangement is the inadvertent mixing of components, whereby an incorrect component may inadvertently be dropped into the wrong tray or bin with the result with the result that the wrong component may be selected at some time in the future.

Whilst the above disadvantage can to a great extent be overcome by providing lidded trays or bins for the components, there is another problem which to date has not been satisfactorily overcome.

Because the components in question are required very frequently, it is necessary to have a relatively large stock to ensure that production can continue. If this does not occur then the production of the whole article may temporarily terminate as a result of the absence of one particular component. Thus, it is common for a stock control person to monitor the level of each component. When the level of a component falls below a desired level the stock control person merely locates the appropriate components from the stores and then fills up the appropriate tray or bin with the components.

One significant disadvantage is that such practices inevitably result in a "residue" of components at the base of the tray or bin which never get used or which only get used after a very long period of time.

This increases the likelihood of damage to the components before they are fitted.

Moreover, it will be observed that with the existing practice different batches of components are mixed together, which makes it very difficult to trace the source of a particular component should this be necessary. One consequence of this is that if a particular component is found to fail a test when in position on the finished article, then it is necessary to test all of the identical components on the article since it is impossible to determine from which batch each component originated.

The dispenser disclosed in GB-A-2,327,668 allows all of the above problems to be overcome and in particular the problems of overstocking and traceability of components are a fraction of their former levels.

However, such dispensers have to be checked and refilled manually. Whilst this operation is greatly facilitated as compared with the prior art, the task is still a considerable one when a large number of dispensers is involved. For example, it is not uncommon for several hundred or several thousand dispensers to be installed in a factory. Care must be taken to ensure that there is always an adequate supply of components since failure to do so may result in a whole section of production (or even a production line) being suspended whilst the missing components are sourced.

It is thus an object of the present invention to provide a dispensing device and system which give an improved indication that refilling is required.

In accordance with a first aspect of the present invention, a dispenser comprises a loading chamber, access means for removing the contents of the dispenser and means for generating a signal indicative that the loading chamber is empty.

Preferably, the signal is adapted to actuate a visual indication that the loading chamber requires refilling. The visual indication may be located in the vicinity of the dispenser.

In one embodiment, the signal is adapted to illuminate a lamp (e.g. a light emitting diode) to indicate that the loading chamber requires refilling. There may be means for directing light emitting from the lamp. This may take the form of a light guide. Preferably the light guide enables light from the lamp to be visible from the front of the dispenser. The lamp may be located on a support on which the dispenser is mounted.

In a preferred embodiment, the dispenser further comprises a gate or shutter which is movable to allow the contents of the loading chamber to be discharged from the loading chamber. Preferably, the gate or shutter forms a lower wall of the loading chamber.

The means for generating a signal indicative that the loading chamber is empty may comprise means for sensing movement of the gate or shutter to a position where the contents of the loading chamber are displaced out of the loading chamber. The means for sensing movement of the gate or shutter may comprise a limit switch actuated by the gate or shutter.

Preferably, opening of the gate or shutter discharges the contents of the loading chamber to the axis means. Preferably, the axis means comprises a further chamber. Advantageously, the further chamber is located below the loading chamber and preferably it comprises an openable cover.

In a preferred embodiment, the loading chamber further comprises an openable cover to allow loading. There may be locking means for selectively locking the cover of the loading chamber. Preferably, the locking means locks the cover of the loading chamber shut in the absence of a signal indicative that the loading chamber is empty.

In one embodiment, the locking means comprises a locking member which is movable from a first, locked position in which it prevents the closed cover from being opened and a second, unlocked position in which it permits the cover to be opened. Preferably the locking member engages the cover in the first, locked position.

Preferably, the locking member is movable by an electrically-operated actuator, e.g. a solenoid actuator.

In one embodiment, the signal indicative that the loading chamber is empty is transmitted to a control means as a notification that the loading chamber requires refilling.

The dispenser preferably further comprises means for cancelling the signal which is indicative that the loading chamber is empty. This may comprise manually operated means for cancelling the signal, which may be located on the dispenser. Alternatively, or in addition, the dispenser further comprises means for generating a cancelling signal from a control means.

The dispenser may further comprise means for informing the control means that the loading chamber has been refilled.

In accordance with a second aspect of the present invention, a dispensing system comprises a plurality of dispenser in accordance with the first aspect of the present invention.

Preferably, the dispensing system comprises mounting means for mounting a plurality of dispensers in proximity to each other. There may also be interengaging electrical connectors on the dispensers and on the mounting means.

The dispensing system may further comprise a control means for receiving the signal from each dispenser indicative that its loading chamber is empty. Preferably, the signal identifies the dispenser from which the signal originates. The signal may also identify the contents of the dispenser.

Preferably, the control means comprise a computer. The control means may also be adapted to reorder stock in response to receipt of a signal indicative that a loading chamber is empty.

By way of example only, a specific embodiment of the present invention will now be described, with reference to the accompanying drawings, in which.

Figure 1:
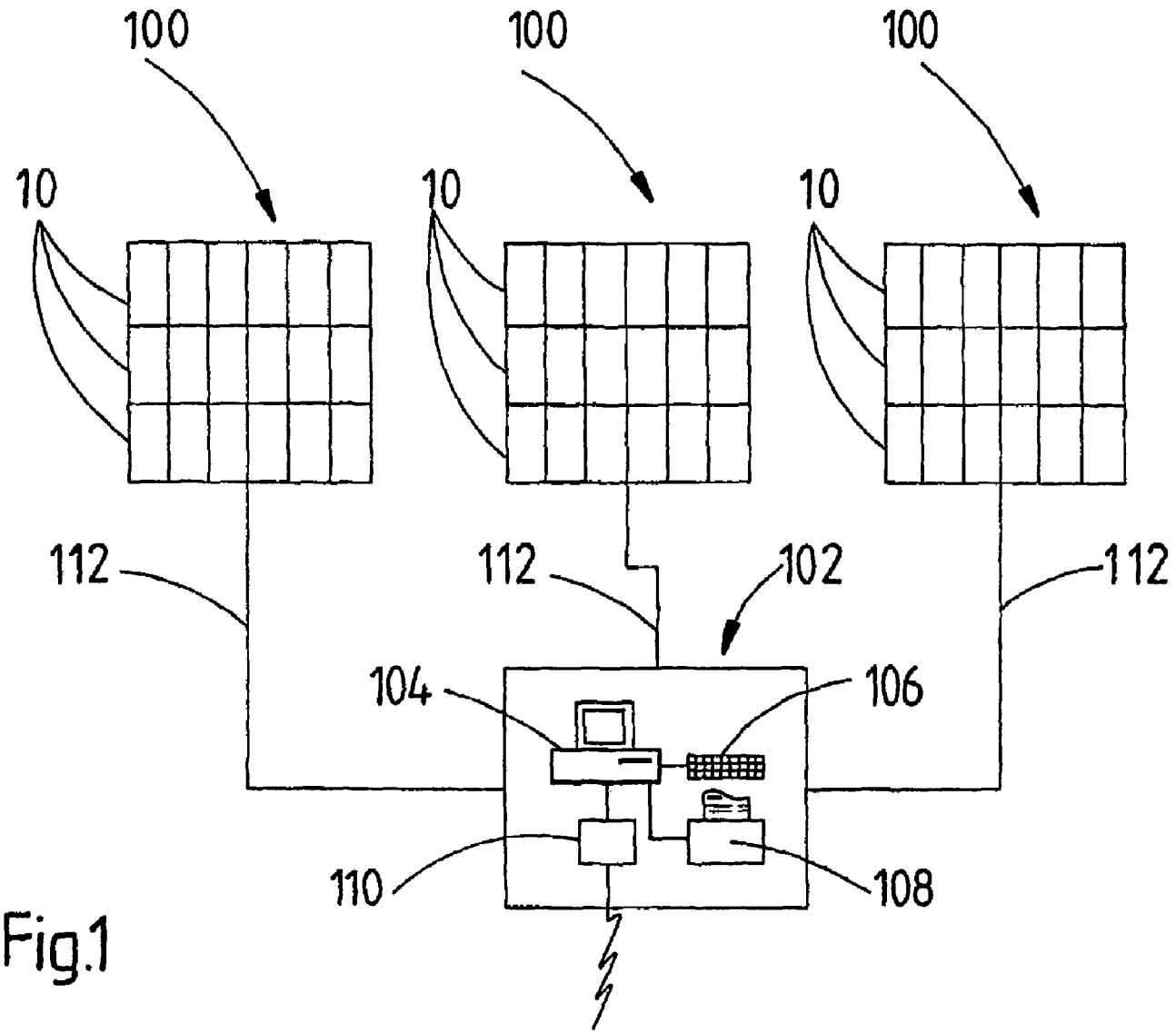
FIG. 1 is a schematic illustration of a dispensing system in accordance with the present invention.

Referring firstly to FIG. 1, a dispensing system comprises one or more banks 100 of dispensers 10 connected to a central monitoring and control station 102, typically comprising a computer 104 having an input device 106 such as a keyboard, a printer 108 and a modem 110 or other device for communicating with suppliers and the like, as will be explained. Three banks 100 of dispensers are illustrated but the number may be anything form one upwards. The communication between the banks 100 of dispensers and the monitoring and control station 102 is typically by means of wires 112, but other forms of communication such as fibre optic links or wireless links (e.g. radio links) may be used.

Figure 3:
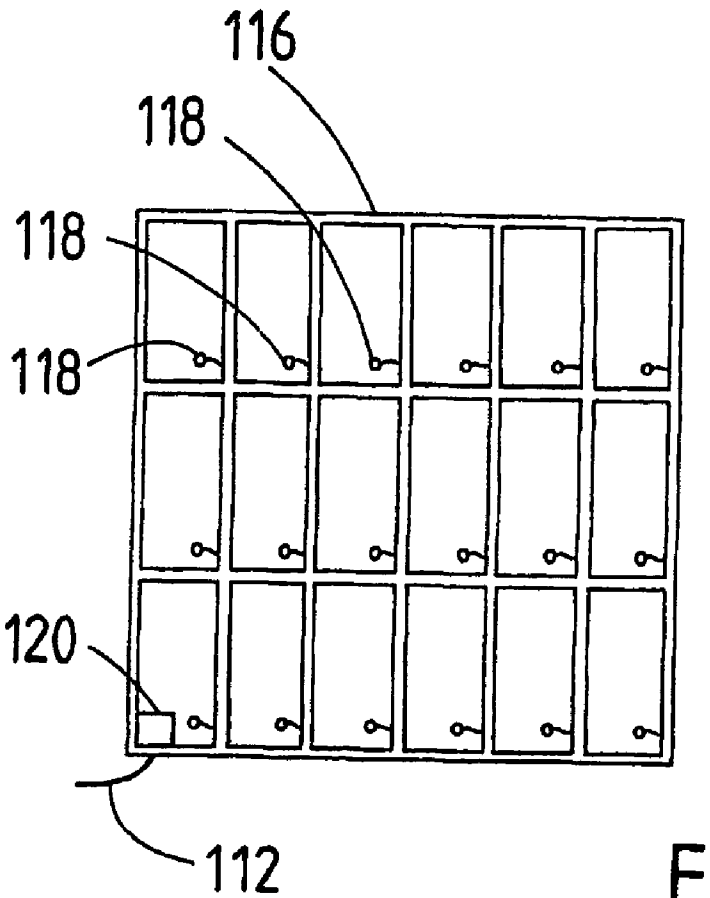
FIG. 3 is a rear view of the bank of dispensers of FIG. 2.
Figure 2:
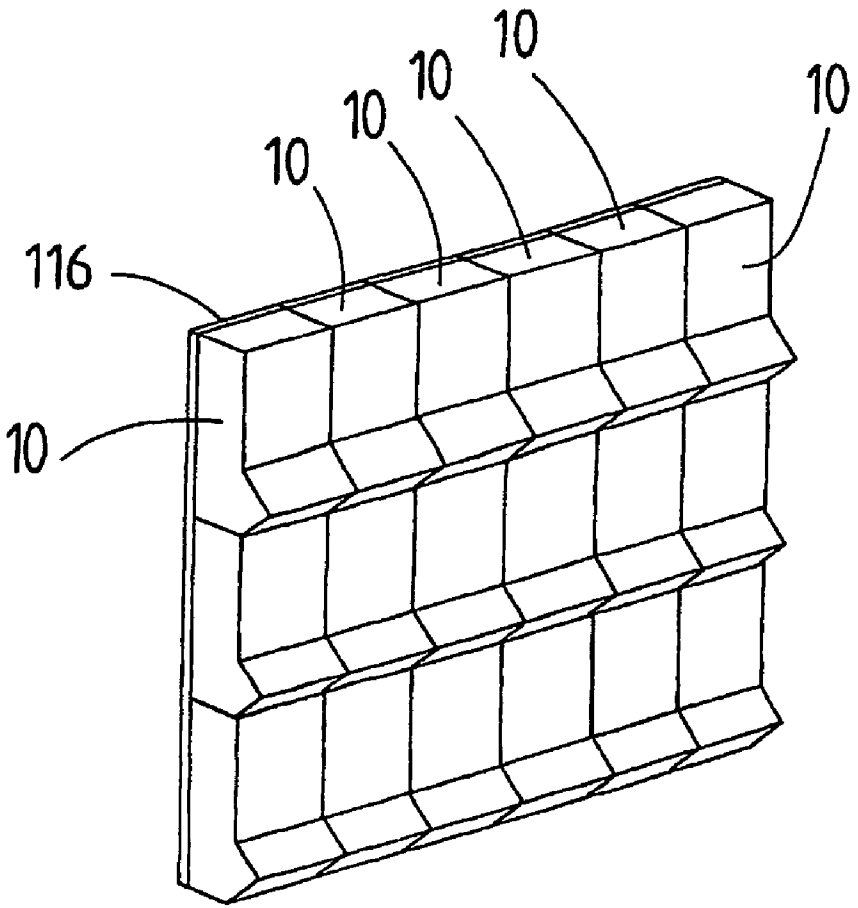
FIG. 2 is a perspective view of a bank of dispensers forming part of the dispensing system of FIG. 1.

Referring to FIGS. 2 and 3, each bank of dispensers comprises a supporting framework 116 on which a plurality of dispensers 10 (to be described later) is mounted. The framework comprises a pre-wired connector 11 for each dispenser, the connector being connected to a local junction box 120 on the framework, by means of which signals are sent to, and received from, the monitoring and control station 102 via the wires 112.

Figure 4:
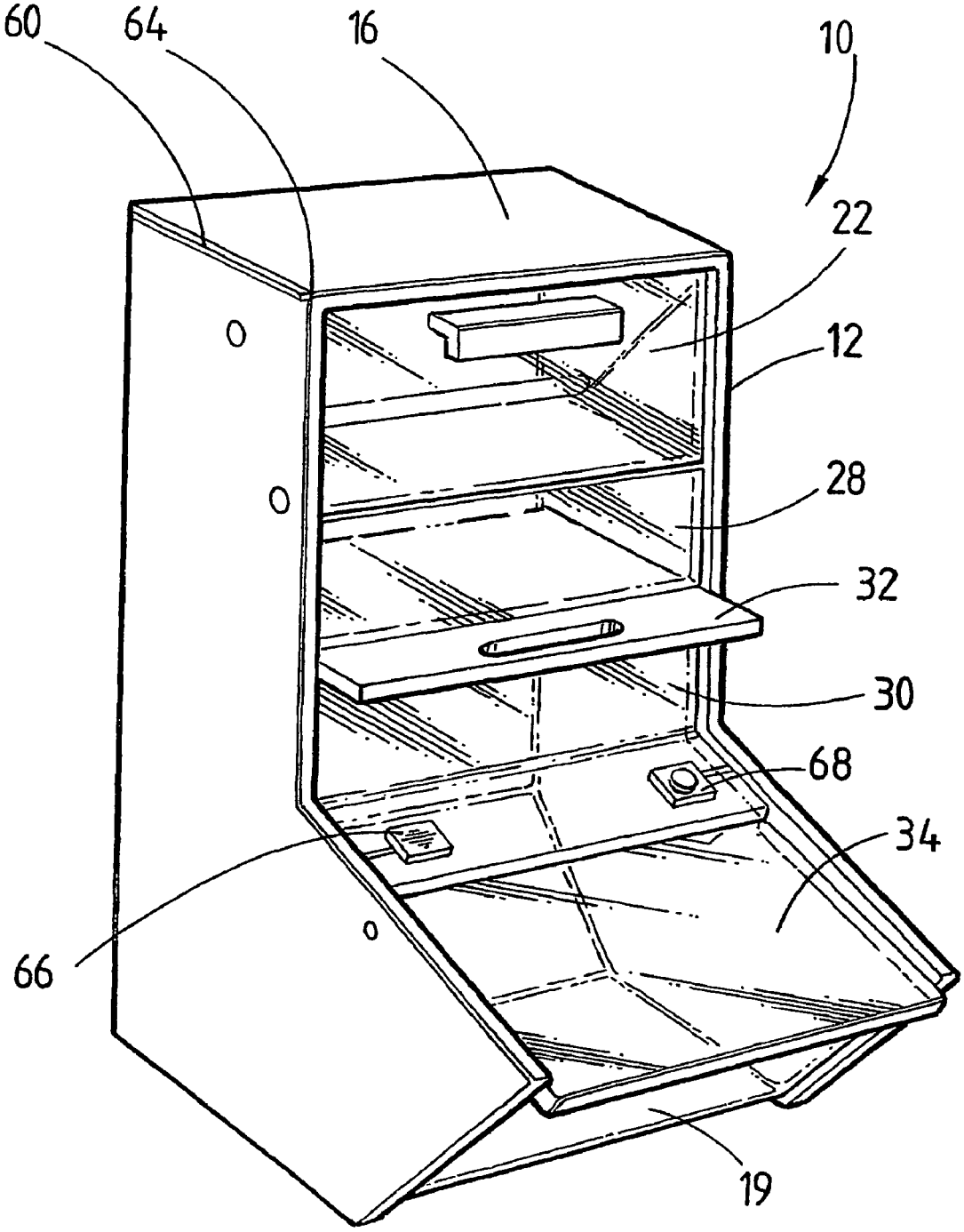
FIG. 4 is a perspective view of a dispenser forming part of the bank of dispensers of FIG. 2, shown in a first position.
Figure 5:
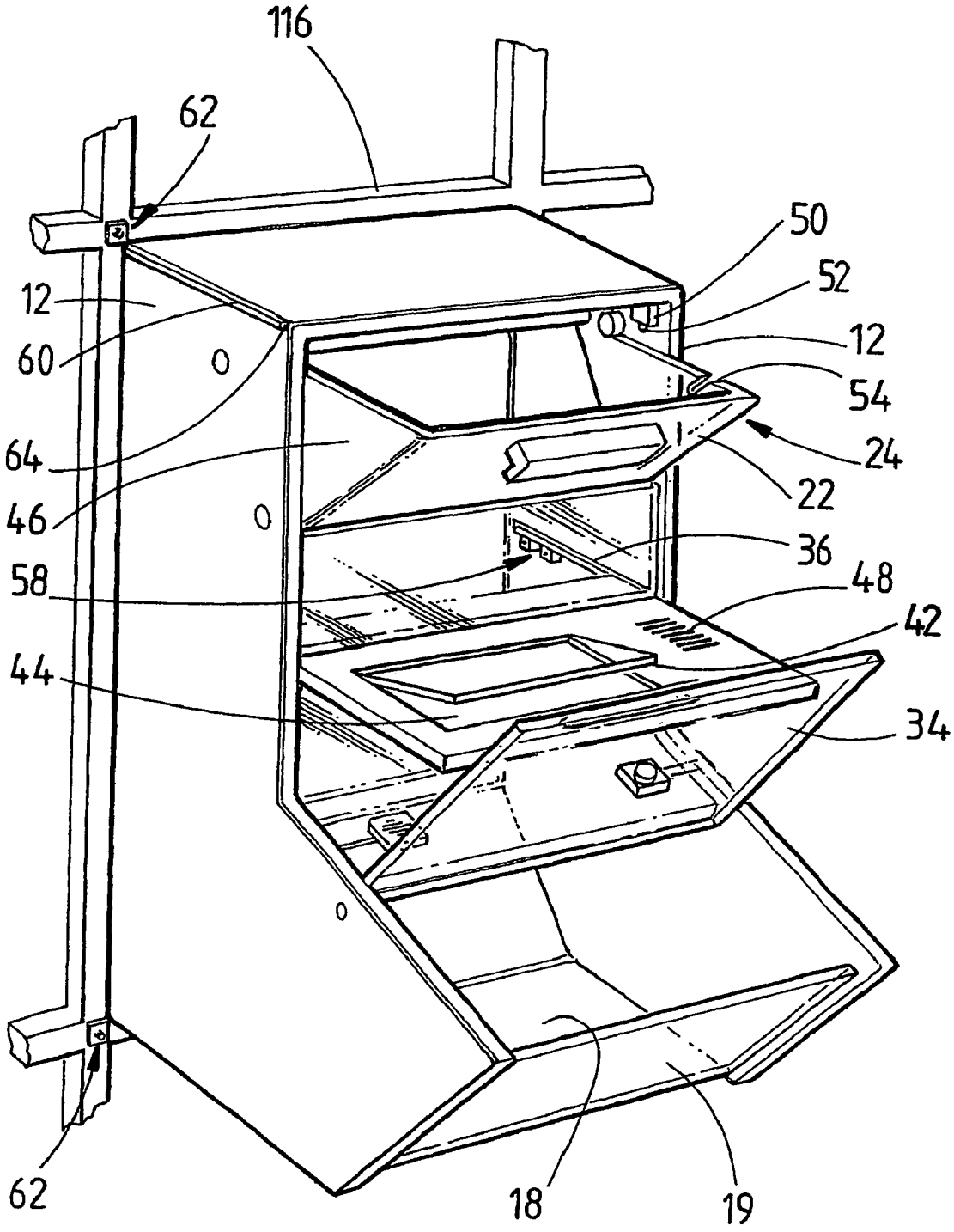
FIG. 5 is a perspective view of the dispenser of FIG. 4, shown in an alternative position.
Figure 6:
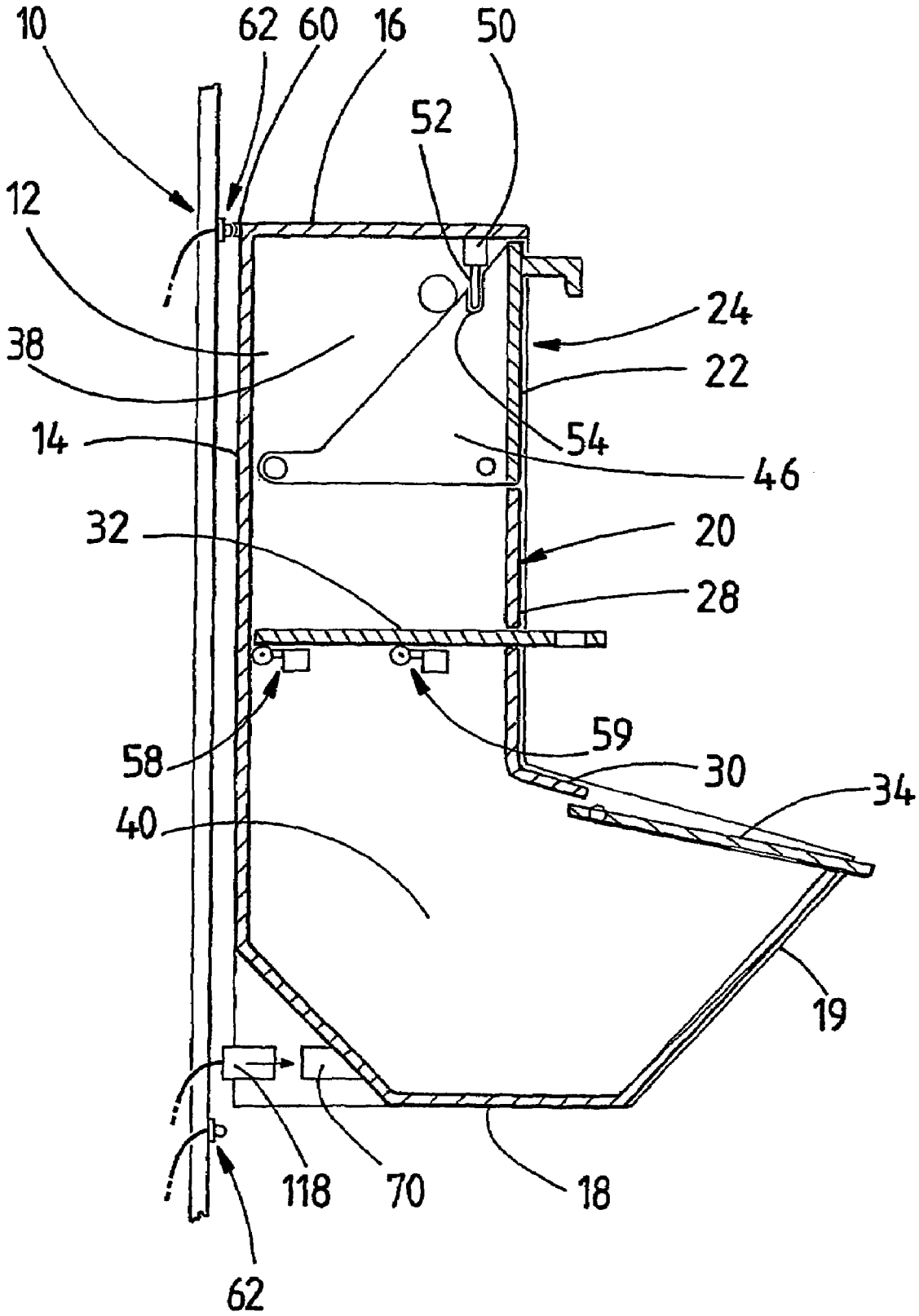
FIG. 6 is a transverse cross-sectional view through the dispenser of FIG. 3.

Referring to FIGS. 4 to 6, each dispenser is very similar to the dispenser described in GB-A-2,327,668. Each dispenser comprises a housing 10 which is conveniently made from a plastics material. The housing comprises two parallel planar generally L-shaped side walls 12, a vertical, planar, rectangular rear wall 14, a rectangular, planar upper wall 16, a rectangular, planar base 18, a lower, forwardly inclined front wall 19 and a main, upper, transparent front wall 20.

The upper transparent front wall 20 comprises the front rectangular planar face 22 of an upper hinged loading lid 24, a central wall portion 26 which is divided into a main, vertical wall portion 28 and a lower, L-shaped wall portion 30 by virtue of a slidable gate or shutter 32 (to be described in more detail hereinafter) and a lower hinged lid 34.

The gate or shutter 32 is slidably disposed in channels 36 provided on the inner faces of each of the side walls 12 and divides the internal volume of the housing into an upper, loading chamber 38 and a lower, dispensing chamber 40 which provides access to allow the contents of the dispenser to be removed.

The gate or shutter 32 can be moved from a first, shut position illustrated in FIG. 3, in which the loading chamber 38 and dispensing chamber 40 cannot communicate, to an open position illustrated in FIG. 4, in which the gate or shutter 32 is partially displaced out of the housing, thereby allowing the loading chamber 38 and dispensing chamber 40 to communicate.

The upper surface of the gate or shutter 32 is also provided with a transparent hinged cover 42 which can be hinged upwardly, as shown in FIG. 4, to reveal a writing surface 44 beneath in the form of a stock control record. It will also be noted that the upper lid 24 is provided with side walls 46 to assist in ensuring that all of the components of a batch are correctly loaded in the upper, loading chamber 38.

The upper hinged loading lid 24 may be held in the locked position by means of an electrically-actuated lock member 50. The lock member 50 is mounted on the inner face of one of the side walls 12 of the dispenser and is electrically actuable between (a) a first, locked condition in which a retaining pin 52 engages with a pin-receiving slot 54 in the upper edge of one of the side walls 46 of the upper lid 24 and merely prevents the lid from being opened and (b) a second, unlocked condition in which the pin 52 is withdrawn from the slot 54, thereby allowing the upper lid to be hinged to an open position.

A first limit switch 58 is also provided on the same inner face of the side wall 12 of the dispenser. The limit switch 58 is tripped (i.e. the circuit is closed) when the gate of shutter 32 is partially or fully withdrawn from its fully closed position, as will be explained. A second limit switch 59 is also provided on the same inner face as the first limit switch 58, between the first limit switch and the front wall. The second switch is tripped when the gate is moved further to its fully open position and is indicative that the upper chamber 38 is empty.

As also shown in FIGS. 4 to 6, one uppermost edge of the dispenser 10 is provided with an elongate, straight transparent acrylic strip 60 extending from rear to front. The strip 60 forms a light guide to transmit light generated by an LED 62 secured to the framework 116 and to output light from its front face 64, as will be explained. The front face 64 may be frosted or otherwise treated to improve the visibility of light emerging from the acrylic strip 60. A separate LED 62 is associated with the acrylic strip 60 on each dispenser, as indicated in FIG. 5.

The inclined wall portion 30 is also provided with an electrically actuated buzzer 66 and a reset switch 68, as will be explained.

The electrical connections to the lock member 50, the limit switch 58, the buzzer 66 and the reset switch 68 are all fed to a socket 70 at the rear of the dispenser, for electrical engagement with the respective connector 118 on the framework.

In use, the appropriate dispensers 10 are mounted on the framework 116 to form one or more banks 100 of dispensers. Electrical connection is established by engaging sockets 70 of the dispensers with the relevant connectors 118 on the framework. Electrical connection is thereby established with the junction box 120 on the framework and thence to the monitoring and control station 102.

Components are loaded into the loading chamber on a batch basis, each dispenser being designated to hold and dispense a particular type of component, which information is stored in the monitoring and control station. In the fully loaded condition, each dispenser is in the condition shown in FIG. 4, but with a full upper, loading chamber 38 and a fill lower, dispensing chamber 40. The components are then taken as desired from the lower, dispensing chamber 40 by lifting the lower lid 34. Removal of the components from the upper, loading chamber 38 is prevented by actuation of the lock member 50 under the control of the monitoring and control station 102, which locks the upper loading lid 24 in the closed position.

When the lower, dispensing chamber 40 is empty, the gate or shutter 32 (which forms the lower wall of the loading chamber 38) is slid to its open position, which allows the components in the upper loading chamber 38 to drop into the dispensing chamber 40. As the gate or shutter is withdrawn, the first limit switch 58 is actuated, which causes the buzzer 66 to sound, indicating that the gate or shutter has been moved from its fully closed position. As the gate or shutter 32 is withdrawn fiber, the second limit switch 59 is tripped, which sends a signal to the control and monitoring station 102 that the gate or shutter has been moved to a position where the contents of the loading chamber will have been discharged from the loading chamber. The control and monitoring station 102 in turn illuminates the LED 62 associated with the dispenser and unlocks the lock member 50. The gate or shutter 32 is then pushed to its filly closed position, whereupon the limit switches 58, 59 are engaged and the buzzer 66 switched off.

The computer 104 also recorders the stock automatically if necessary, and prepares a schedule (eg. on a daily basis) of all the dispensers which require refilling, together with the identity of the component to be loaded.

When the dispensers require refilling (e.g. on a daily basis) the appropriate components are assembled according to the schedule and each dispenser is thereby refilled. Although the schedule will identify which dispensers are to be refilled, the presence of the illuminated LEDs 62, visible via the acrylic strips 60, assists in the location of the empty dispensers on a particular rack The appropriate components are then loaded into the upper loading chamber 38 by opening the upper loading lid which is possible since the lock means 50 will have been unlocked when the gate or shutter 32 was previously pulled out. In order to confirm that the correct component has been loaded, it would be possible to utilise a hand held scanner to scan a bar code or other identifying mark on the components to be loaded and the bar code 48 on the dispenser itself and to issue a warning by actuation of the buzzer 66 if the two do not relate to the same component.

Once the component has been loaded, the lid 24 is pivoted shut. The reset switch 68 is then pressed, which sends a signal to the control and monitoring station 102 which in turn extinguishes the LED 62 and actuates the lock member 50 to retain the lid in the closed position In a variant of the present embodiment, the scanner is connected (e.g. by a radio link) directly to the computer 104 which only unlocks the lock means 50 if the correct component is about to be loaded. In that variant, the person filling the dispenser may be required to scan the bar code 48 on the dispenser again and send an appropriate signal to the computer 104. If the correct component had been identified, the computer would then extinguish the LED 62 and activate the lock member 80 to retain the lid 24 in the closed position.

The invention is not restricted to the details of the foregoing embodiment. In particular, three different variants are envisaged, each utilising a different degree of sophistication.

In a first, basic variant which is particularly useful where the number of dispensers is relatively small, the central monitoring and control station 102 (and the associated wiring 112), limit switches 58, 59, the buzzer 66 and the lock member 50 can be omitted. In this variant, an LED 62 (visible via the acrylic bar 60) would be illuminated to show that the gate or shutter had been opened. The reset switch could then be actuated manually to extinguish the LED once the component had been reloaded.

A second more sophisticated, variant would omit the lock member 50 but would have all the other features described previously.

The third variant would be as described previously, including the electric lock member 50.

However, many other variants could be utilised if desired.

The invention claimed is:

1. A dispenser comprising a loading chamber, access means for removing the contents of the dispenser and means for generating a signal indicative that the loading chamber is empty, wherein the access means comprises a further chamber, and said dispenser further comprising a gate or shutter which is movable to allow the contents of the loading chamber to be discharged from the loading chamber, and wherein the means for generating a signal indicative that the loading chamber is empty comprises means for sensing movement of the gate or shutter to a position where the contents of the loading chamber are displaced out of the loading chamber.

2. A dispenser as claimed in claim 1, wherein the signal is adapted to actuate a visual indication that the loading chamber requires refilling.

3. A dispenser as claimed in claim 2, wherein the visual indication is located in the vicinity of the dispenser.

4. A dispenser as claimed in claim 2, wherein the signal is adapted to illuminate a lamp to indicate that the loading chamber requires refilling.

5. A dispenser as claimed in claim 4, comprising means for directing light emitted from the lamp.

6. A dispenser as claimed in claim 5, wherein the means for directing light comprises a light guide.

7. A dispenser as claimed in claim 6, wherein the light guide enables light from the lamp to be visible from the front of the dispenser.

8. A dispenser as claimed in claim 4, wherein the lamp is located on a support on which the dispenser is mounted.

9. A dispenser as claimed in claim 4, wherein the lamp comprises a light emitting diode.

10. A dispenser as claimed in claim 1, wherein the gate or shutter forms a lower wall of the loading chamber.

11. A dispenser as claimed in claim 1, wherein the means for generating a signal indicative that the loading chamber is empty comprises a limit switch actuated by the gate or shutter.

12. A dispenser as claimed in claim 1, wherein opening the gate or shutter discharges the contents of the loading chamber to the access means.

13. A dispenser as claimed in claim 1, wherein the further chamber is located below the loading chamber.

14. A dispenser as claimed in claim 1, wherein the further chamber comprises an openable cover.

15. A dispenser as claimed in claim 1, wherein the loading chamber comprises an openable cover to allow loading.

16. A dispenser as claimed in claim 15, further comprising locking means for selectively locking the cover of the loading chamber.

17. A dispenser as claimed in claim 16, wherein the locking means locks the cover of the loading chamber shut in the absence of a signal indicative that the loading chamber is empty.

18. A dispenser as claimed in claim 16, wherein the locking means comprises a locking member which is movable between a first, locked position in which it prevents the closed cover from being opened and a second, unlocked position in which it permits the cover to be opened.

19. A dispenser as claimed in claim 18, wherein the locking member engages the cover in the first, locked position.

20. A dispenser as claimed in claim 18, wherein the locking member is movable by an electrically-operated actuator.

21. A dispenser as claimed in claim 20, wherein the locking member is movable by means of a solenoid actuator.

22. A dispenser as claimed in claim 1, wherein the signal indicative that the loading chamber is empty is transmitted to a control means as a notification that the loading chamber requires refilling.

23. A dispenser as claimed in claim 1, further comprising means for cancelling the signal which is indicative that the loading chamber is empty.

24. A dispenser as claimed in claim 23, comprising manually operated means for cancelling the signal.

25. A dispenser as claimed in claim 24, wherein the cancelling means is located on the dispenser.

26. A dispenser as claimed in claim 24, further comprising means for generating a cancelling signal from a control means.

27. A dispenser as claimed in claim 26, comprising means for informing the control means that the loading chamber has been refilled.

28. A dispensing system comprising a plurality of dispensers as claimed in claim 1.

29. A dispensing system as claimed in claim 28, further comprising mounting means for mounting a plurality of dispensers in proximity to each other.

30. A dispensing system as claimed in claim 29, wherein the mounting means comprises a support frame.

31. A dispensing system as claimed in claim 29, comprising interengaging electrical connectors on the dispensers and the mounting means.

32. A dispensing system as claimed claim 1, further comprising a control means for receiving a signal from each dispenser indicative that its loading chamber is empty.

33. A dispensing system as claimed in claim 32, wherein the signal identifies the dispenser from which the signal originates.

34. A dispensing system as claimed in claim 33, wherein the signal identifies the contents of the dispenser.

35. A dispensing system as claimed in claim 32, wherein the control means comprises a computer.

36. A dispensing system as claimed in claim 32, wherein the control means is adapted to reorder stock in response to receipt of a signal indicative that a loading chamber is empty.

37. A dispenser comprising a loading chamber, access means for removing the contents of the dispenser and means for generating a signal indicative that the loading chamber is empty, wherein the access means comprises a further chamber and wherein the loading chamber comprises an openable cover to allow loading, said dispenser further comprising locking means for selectively locking the cover of the loading chamber, wherein the locking means locks the cover of the loading chamber shut in the absence of a signal indicative that the loading chamber is empty.

38. A dispenser as claimed in claim 37, wherein the locking means comprises a locking member which is movable between a first, locked position in which it prevents the closed cover from being opened and a second, unlocked position in which it permits the cover to be opened.

39. A dispenser as claimed in claim 38, wherein the locking member engages the cover in the first, locked position.

* * * * *

UNITED STATES PATENT AND TRADEMARK OFFICE

CERTIFICATE OF CORRECTION

PATENT NO. : 7,146,246 B2
APPLICATION NO. : 10/471801
DATED : December 5, 2006
INVENTOR(S) : Clarke It is certified that error appears in the above-identified patent and that said Letters Patent is hereby corrected as shown below:

On the Cover Page, insert the following information:

-- Related U.S. Application Data
(60) Provisional Application No. 60/288,462, filed on May 4, 2001.--

Signed and Sealed this

Eighth Day of May, 2007

JON W. DUDAS
*Director of the United States Patent and Trademark Office*